US011037534B2

(12) United States Patent
Bradley et al.

(10) Patent No.: US 11,037,534 B2
(45) Date of Patent: Jun. 15, 2021

(54) OCTAVETOUCH FRETPAD

(71) Applicants: Christopher Michael Bradley, Orinda, CA (US); Daniel William Cornish, Morage, CA (US); Alan Scott Crarer, Santa Cruz, CA (US)

(72) Inventors: Christopher Michael Bradley, Orinda, CA (US); Daniel William Cornish, Morage, CA (US); Alan Scott Crarer, Santa Cruz, CA (US)

( * ) Notice: Subject to any disclaimer, the term of this patent is extended or adjusted under 35 U.S.C. 154(b) by 0 days.

(21) Appl. No.: 16/699,394

(22) Filed: Nov. 29, 2019

(65) Prior Publication Data

US 2020/0175950 A1 Jun. 4, 2020

Related U.S. Application Data

(60) Provisional application No. 62/773,718, filed on Nov. 30, 2018.

(51) Int. Cl.
*G10D 3/053* (2020.01)

(52) U.S. Cl.
CPC ..... *G10D 3/053* (2020.02)

(58) Field of Classification Search
None
See application file for complete search history.

(56) References Cited

U.S. PATENT DOCUMENTS 514,263 A * 2/1894 Filstrup ..... G10D 3/053 84/318
608,278 A * 8/1898 Benson ..... G10D 3/053 84/318
3,722,346 A * 3/1973 Valentino ..... G10D 3/053 84/318
4,048,894 A * 9/1977 Myerson ..... G10D 3/053 84/318
4,252,046 A * 2/1981 Myerson ..... G10D 3/053 84/318
4,304,165 A * 12/1981 Gould ..... G10D 3/053 84/318
4,324,165 A * 4/1982 Wilkerson ..... G10D 3/053 84/318
5,284,077 A * 2/1994 Ellis ..... G10D 3/053 84/318
6,008,441 A * 12/1999 Steinberger ..... G10D 3/053 84/318
6,528,711 B1 * 3/2003 Paige ..... G10D 3/053 84/318
7,932,450 B2 * 4/2011 Chen ..... G10D 3/053 84/318

(Continued)

FOREIGN PATENT DOCUMENTS

DE 1927958 A1 * 12/1970 ..... G10D 3/053
WO WO-2013077894 A1 * 5/2013 ..... G10D 3/053

*Primary Examiner* — Robert W Horn
(74) *Attorney, Agent, or Firm* — NetLawyers LLP

(57) ABSTRACT

The present invention is directed to a capo, or a fretpad for a capo, for use with a stringed musical instrument. The fretpad is manufactured from a pliable material that mimics the compression of a human finger, and which prevents the instrument from going out of tune prematurely. The fretpad insert is radiused and configured to be insertable into a frame, which may be detachably connected to a capo body.

20 Claims, 12 Drawing Sheets

(56) References Cited

U.S. PATENT DOCUMENTS

| | | | | |
|---|---|---|---|---|
| 8,779,261 | B2 * | 7/2014 | Dunlop | G10D 3/00 84/318 |
| 9,454,946 | B2 * | 9/2016 | Bradley | G10D 3/053 |
| 9,711,115 | B2 * | 7/2017 | Bradley | G10D 3/053 |
| 9,754,563 | B1 * | 9/2017 | Chen | G10D 3/053 |
| 10,297,236 | B1 * | 5/2019 | Steinberger | G10D 3/053 |
| 2020/0013309 | A1 * | 1/2020 | Zintel | G09B 15/004 |
| 2020/0175950 | A1 * | 6/2020 | Bradley | G10D 3/053 |

* cited by examiner

OCTAVETOUCH FRETPAD

CROSS-REFERENCE TO RELATED APPLICATIONS

The present application claims the benefit of U.S. Provisional Application No. 62/773,718 filed on Nov. 30, 2018, incorporated by reference herein and for which benefit of the priority date is hereby claimed.

FEDERALLY SPONSORED RESEARCH

Not applicable.

SEQUENCE LISTING OR PROGRAM

Not applicable.

FIELD OF INVENTION

The present invention relates to a capo, for use with a stringed musical instrument to effectively change the key in which the instrument is playing. More particularly, the present invention relates to the fretpad of a capo that is capable providing appropriate tension to the strings so that the instrument remains in tune.

BACKGROUND OF THE INVENTION

A number of different capos are known for use with stringed musical instruments, particularly guitars, banjos and the like, which have a neck portion including a fretboard on which the strings are played. The capo is a clamping device which fits on the instrument neck, and which is used to selectively clamp the strings against the fretboard so as to alter the effective length of vibration of the strings, and thereby to selectively raise the respective tones produced thereby.

A number of different capos are known and commercially available. Each of these is basically a clamping device in which a padded clamping bar is caused to press transversely across the strings by operation of an adjustable clamping mechanism that interacts with the underside of the neck below the fretboard.

An invention is needed that specifically addresses the problem of capos pushing an instrument out of tune.

Most capos have neck pads comprised of fixed rubber cross bar that press down on the fret. Capos with different fixed neck pads can be used to change different characteristics. For example, a capo can come in 5 different models with neck pad lengths ranging from 40 mm to 65 mm.

One style of capo is known as a strap-on. In a strap-on capo, a rubber-covered bar is placed over the strings and a strap is attached to either end of the bar (wrapped around the back of the neck of the instrument) which holds the bar tightly to the neck. A strap-on capo commonly features either an elastic strap, or a fabric strap which can be adjusted by some method to set tightness.

Modern twists on the strap-on include a semi-flexible plastic "strap" connected to the bar on one side which is adjustable on the other side by a ratchet system. Strap-on capos vary from the other types of capos in that most other capos contain only rigid parts, and most other styles do not wrap entirely around the neck of the instrument. This full wrap allows for fairly even pressure of the capo bar across all of the strings of the instrument. The strap-on capo is commonly a low-cost capo option, and is one of the earlier styles of capo. Because the strap material is stretched to create a tight fit, the straps on these capos can be prone to stretching and wear.

One of the more common modern capo styles is the spring-clamp "trigger-style". The most common form of this type of capo has two bars: a rubber-covered bar to barre the strings, and another that presses against the back of the neck of the instrument to hold the first bar to the strings (this second bar is commonly curved or shaped to match the contour of the back of the neck). The two bars are attached on a pivot at one end; a spring presses the bars together.

Each bar has a 'grip' attached at a right angle to the bar; the two grips, when squeezed together by the user, pull the two bars apart, allowing the user to quickly release the capo's grip, apply or adjust the capo, then release the grips, allowing the spring to pull the bars together again. The look of the grips, and the action of squeezing them is akin to a gun's trigger, leading to the name of this capo. These are the most common design referred to as "quick-release" capos.

Though other styles also use that term, the trigger-style capo, because it can be operated by one hand in one single squeezing motion, is typically the quickest capo to apply or move on the instrument; other capos can be quicker and easier to remove from the instrument. One disadvantage to the trigger-style capo is that the pressure of the spring is not adjustable. The spring will apply its maximum pressure to hold the strings down, which could have an effect on the tuning of some guitars if not applied properly. These capos can typically be applied either to the treble or bass side of the instrument, depending on the player's preference. Trigger-style capos are engaged from the upper portion of the neck; in other words, as you are holding a stringed instrument in playing position with the neck horizontal, the capo is engaged with the neck by squeezing the capo to open it above the neck and bring it down from above the upper portion of the neck (distal to the ground on a horizontal plane) to engage with the neck.

There are numerous other forms of capos, many of which are variations on the above-noted designs, including: a) a screw-on capo which has some form of surface that presses against the back of the neck of the instrument to hold the bar in place against the strings. This back surface is held to the neck by a screw which is tightened to apply direct pressure. One form of this capo is effectively a rubber-covered bar built into a C-clamp; b) a roller capo facilitates quick key changes in the middle of tunes or sets by having rollers both holding down the strings and behind the neck, allowing the capo to roll along the neck when needed. This is a particular advantage in playing Irish music on the guitar, as it enables the player to move quickly between keys without sacrificing drone strings; and c) fifth-string capo: The five-string banjo, with its short fifth string, poses a particular problem for using the capo.

While the foregoing examples of capos and other tools are usable for their intended purposes, a need still exists in the art for an improved capo with a fretpad capable of providing the appropriate tension to the instrument. In particular, there is a need for an improved fretpad, and method of engaging same, which is capable of being engaged, disengaged and adjusted quickly. Specifically, there is a need for a capo with a fretpad that will not cause the instrument to go out of tune.

SUMMARY OF THE INVENTION

In accordance with the present invention, there is an OctaveTouch fretpad that is configured to be used without pushing a guitar out of tune. In one embodiment of the present invention, there is an OctiveTouch fretpad that is configured to be used without pushing a 12-string guitar out of tune. In one embodiment of the present invention, there is an OctiveTouch fretpad that works on all 12-string and baritone guitars, regardless of how they are strung (some are strung with the octave string on the bass side and some on the treble side of the standard gauge string.)

12-string guitars are notoriously finicky and some don't work well with capos, especially with respect to the octave strings. A 12-string capo usually means a capo with higher tension. This is because the capo needs to fret the standard gauge string and the smaller gauge octave string in order to get both strings to ring true. The issue with this approach is that you will undoubtedly push your guitar out of tune when you crank up the tension.

The present invention solved this problem by modeling a new fretpad material after the human finger. Initially, fretpads were made out of every durometer of rubber that that could be sourced. Durometer refers to the softness or elasticity of rubber materials. It was discovered that some were too soft, and some were not soft enough. Additionally, fretpad were manufactured from every type of rubber from silicone to butyl rubber, including mixing custom batches or blends with different additives. One problem encountered was that if the fretpad was too soft, it didn't depress the strings enough and resulted in an unpleasant buzzing. If the fretpad was too hard, it would not adequately conform around the strings. Experiments were conducted with metal cores inside of the rubber, as well as numerous other methods. Eventually, the problem was solved with a silicone blend that exactly matches the elasticity of the human finger. We refer to this fretpad material as OctaveTouch.

In one experiment, the OctaveTouch fretpad in standard tension depth was better at keeping a 6-string guitar in tune than a rubber fretpad. In a test with a Gibson SJ200, a Peterson Strobe Tuner and a Thalia Capo with a standard-tension OctaveTouch fretpad installed at the 5th fret, the capo kept the guitar perfectly in tune to ear, but consistently 4-5 cents sharper than without the capo on according to the Peterson tuner. With the capo off and barred the 5th fret with fingers, modulating the pressure of barring to the point just above where buzzing occurred while watching the Peterson Strobe Tuner, the result was the barre chord was also 4-5 cents sharp.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 1:
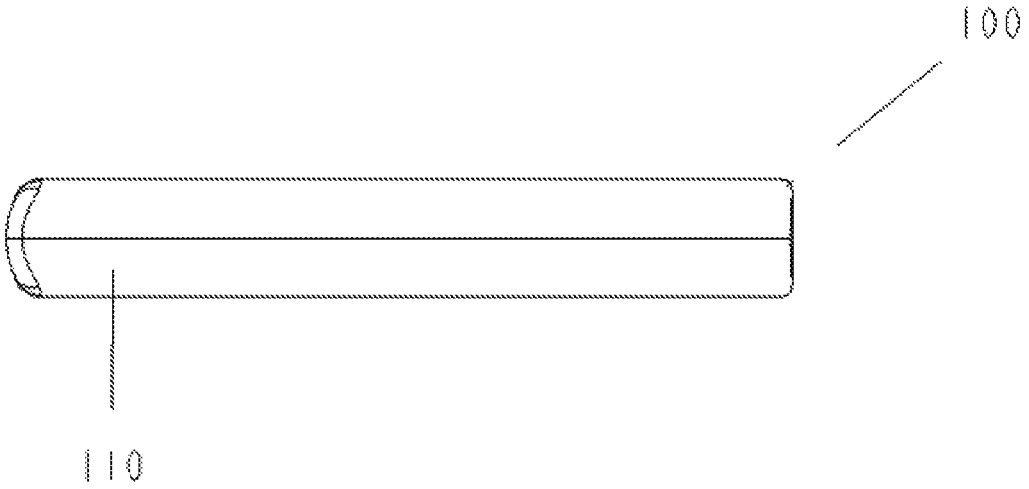
FIG. 1 is a bottom view diagram of the radiused fretpad insert.

Before the invention is described in further detail, it is to be understood that the invention is not limited to the particular embodiments described, as such may, of course, vary. It is also to be understood that the terminology used herein is for the purpose of describing particular embodiments only, and not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed with the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, if dates of publication are provided, they may be different from the actual publication dates and may need to be confirmed independently.

It should be further understood that the examples and embodiments pertaining to the systems and methods disclosed herein are not meant to limit the possible implementations of the present technology. Further, although the subject matter has been described in a language specific to structural features and/or methodological acts, it is to be understood that the subject matter defined in the appended claims is not necessarily limited to the specific features or acts described above. Rather, the specific features and acts described above are disclosed as example forms of implementing the Claims.

A human finger reacts to strings on a guitar, including a 12-string guitar. The finger tip is initially very soft, molding around the strings but then quickly bottoms out on bone, so that both strings are pressed against the fret with equal tension. When you barre with the side of your finger, the fleshy part of the finger makes contact with the fretboard and depresses the octave strings.

When a rubber fretpad makes contact with the strings, the rubber conforms slightly to the strings, but it is nowhere as soft or as pliable as a finger. This means that a lot of force is being applied to the standard gauge strings in order to press then down far enough to hit the octave strings.

One embodiment of the present invention is referred to as an OctaveTouch fretpad. Note that the OctaveTouch fretpad does not have grooves, but appears to have the profile of a fretpad which does have grooves when it is applied to a guitar. In one embodiment of the present invention, the OctaveTouch fretpad is made of silicone with no special additives with a 25 durometer. In one embodiment of the present invention, the OctaveTouch fretpad is made of silicone mixed with additives with a 25 durometer. In one embodiment of the present invention, the OctaveTouch fretpad is made of a material other than silicone with a 25 durometer. In one embodiment of the present invention, the OctaveTouch fretpad is made of silicone with a durometer in the range of 15-40. In one embodiment of the present invention, the OctaveTouch fretpad is made of a material other than silicone with a durometer in the range of 15-40. In one embodiment of the present invention, the fretpad is radiused, meaning that instead of being flat, the fretpad has a radius or curve that goes across the fingerboard of a guitar in line with the frets.

Turning now to FIG. 1, shown is a bottom view diagram of the radiused fretpad insert 100. The radius feature 110 is the front face of the radiused fretpad insert 100 that is applied to the strings across the fretboard of a guitar when integrated into a capo. The radiused fretpad insert 100 is manufactured out of rubber, silicone, or hybrid mixture. The radiused fretpad insert 100 defines the radius and the strings of a guitar that are to be compressed. In a partial version of the radiused fretpad insert 100 there are cutouts to allow certain strings to ring free. In the full version of the radiused fretpad insert 100 as shown, all strings are compressed. The material and elastomeric properties of radiused fretpad insert 100 define the function. Standard rubber fretpads are often made of a harder butyl rubber, while the radiused fretpad insert 100 can be made from a softer silicone rubber. The radius feature 110 goes across the strings of a guitar and is a defined radius to match the instruments fretboard radius.

Figure 2:
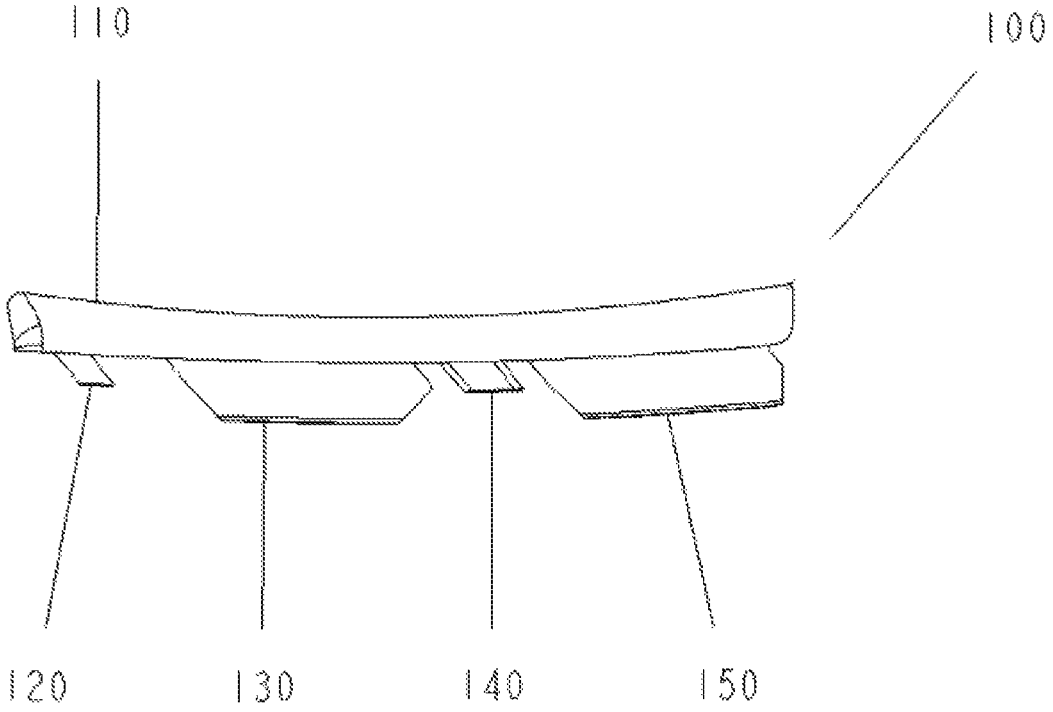
FIG. 2 is an upsidedown side view diagram of the radiused fretpad insert.

Turning now to FIG. 2, shown is an upsidedown side view diagram of the radiused fretpad insert 100 with the radius feature 110 on top and various features along the bottom used for connecting the radiused fretpad insert 100 with a fretpad frame. The front alignment knub feature 120 slots through a fretpad frame for attachment to the fretpad frame and also can further slot into a capo body when inserted to hold it in place and keep it from being pulled out of the capo body when lateral force is applied from sliding capo up the neck of the instrument. The front center alignment knub feature 130 slots through a fretpad frame for attachment to the fretpad frame and can also further slot into the capo body when inserted to hold it in place and keep it from being pulled out of the capo body when lateral force is applied from sliding capo up the neck of the instrument. The center knub feature 140 has a molded number that shows the radius of the fretpad so that a user can readily tell multiple fretpads from one another. The rear center alignment knub feature 150 slots through a fretpad frame for attachment to the fretpad frame and can also slot into the capo body when inserted to hold it in place and keep it from being pulled out of the capo body when lateral force is applied from sliding capo up the neck of the instrument. In one embodiment of the present invention, the front alignment knub feature 120, the front center alignment knub feature 130, the center knub feature 140, and the rear center alignment knub feature 150 are feature protrusions molded with, and from the same material as, the radius feature 110.

Figure 3:
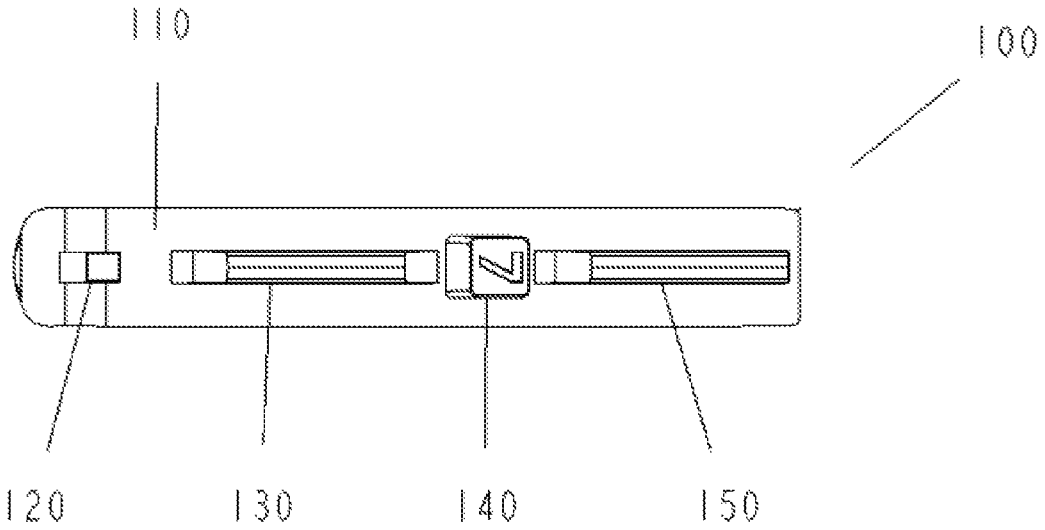
FIG. 3 is a top view diagram of the radiused fretpad insert.

Turning now to FIG. 3, shown is a top view diagram of the radiused fretpad insert 100 with the back of the radius feature 110 shown with various features used for connecting the radiused fretpad insert 100 with a fretpad frame. The front alignment knub feature 120 slots through a fretpad frame for attachment to the fretpad frame and also can further slot into a capo body when inserted to hold it in place and keep it from being pulled out of the capo body when lateral force is applied from sliding capo up the neck of the instrument. The front center alignment knub feature 130 slots through a fretpad frame for attachment to the fretpad frame and can also further slot into the capo body when inserted to hold it in place and keep it from being pulled out of the capo body when lateral force is applied from sliding capo up the neck of the instrument. The center knub feature 140 has a molded number that shows the radius of the fretpad so that a user can readily tell multiple fretpads from one another. The rear center alignment knub feature 150 slots through a fretpad frame for attachment to the fretpad frame and can also slot into the capo body when inserted to hold it in place and keep it from being pulled out of the capo body when lateral force is applied from sliding capo up the neck of the instrument.

Figure 4:
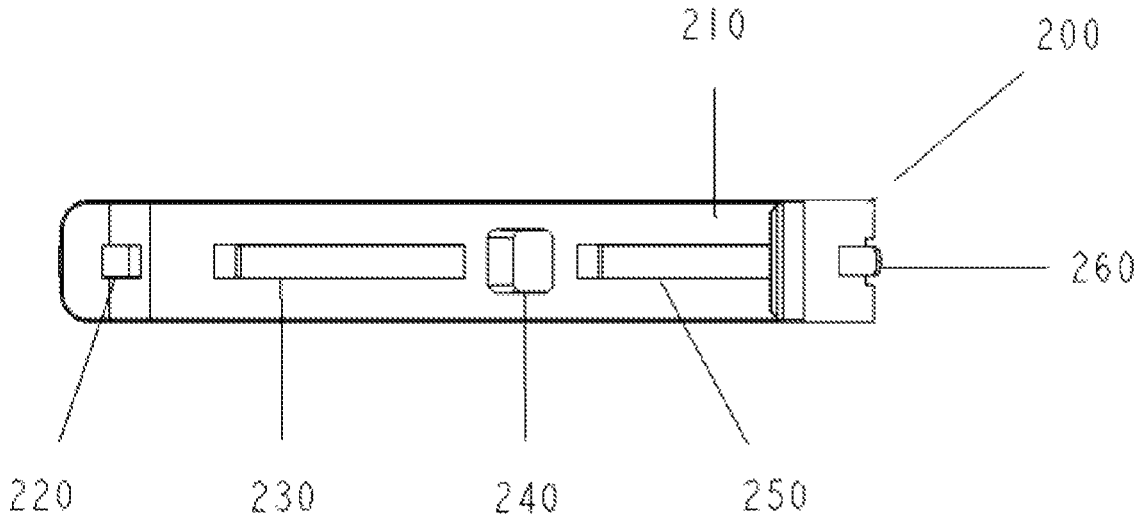
FIG. 4 is a top view diagram of the fretpad frame.

Turning now to FIG. 4, shown is a top view diagram of the fretpad frame 200 which connects with the radiused fretpad insert to provide structure and support for the radiused fretpad insert. The fretpad frame 200 is a hard plastic frame made from polycarbonate, ABS or the like. The fretpad frame top 210 is that part that connects the OctaveTouch fretpad to a capo. Shown on the far left is a frame snap feature 220, a protrusion on fretpad frame top 210 made of plastic and designed to snap into the capo body to keep the OctaveTouch fretpad held in place during use. The front center alignment slot feature 230 is designed to allow the front center alignment knub feature to slot through it for alignment and to increased adhesion to the fretpad frame 200. The center slot feature 240 is designed to allow the front center alignment knub feature to slot through so that a user can see the radius number when assembled. The rear center alignment slot feature 250 is designed to allow the rear center alignment knub feature to slot through it for alignment and to increased adhesion to the fretpad frame 200. The rubber spring slot 260 provides a cavity into which a rubber spring can be adhered.

Figure 5:
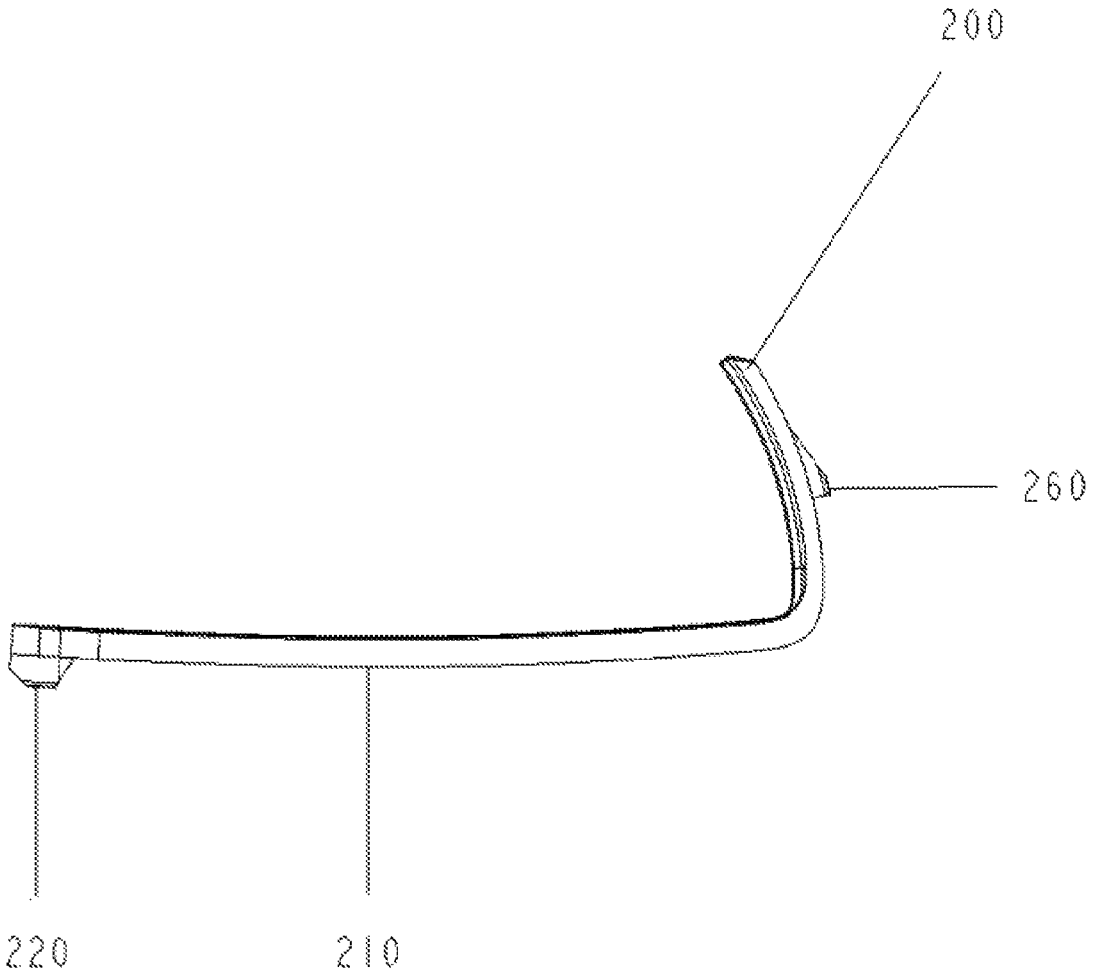
FIG. 5 is an upsidedown side view diagram of the fretpad frame.

Turning now to FIG. 5, shown is an upsidedown side view diagram of the fretpad frame 200. The fretpad frame 200 is a hard plastic frame made from polycarbonate, ABS or the like. The fretpad frame top 210 is that part that connects the OctaveTouch fretpad to a capo. Shown on the far left is a frame snap feature 220, a protrusion on fretpad frame top 210 made of plastic and designed to snap into the capo body to keep the OctaveTouch fretpad held in place during use. The rubber spring 260 is inserted into, connected to, or glued into the rubber spring slot.

Figure 6:
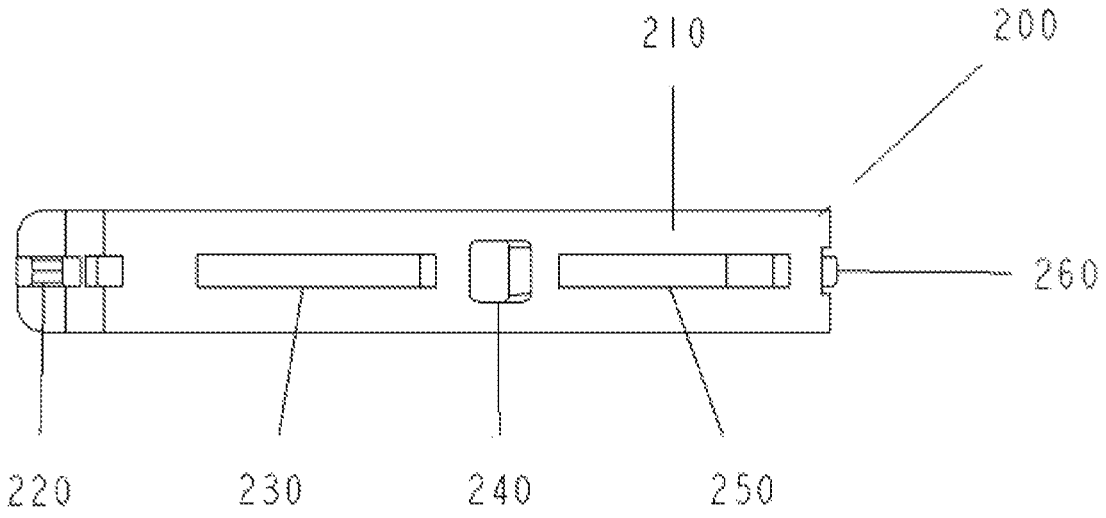
FIG. 6 is a bottom view diagram of the fretpad frame.

Turning now to FIG. 6, shown is a bottom view diagram of the fretpad frame 200 which connects with the radiused fretpad insert to provide structure and support for the radiused fretpad insert. The fretpad frame 200 is a hard plastic frame made from polycarbonate, ABS or the like. The fretpad frame top 210 is that part that connects the OctaveTouch fretpad to a capo. Shown on the far left is a frame snap feature 220, a protrusion on fretpad frame top 210 made of plastic and designed to snap into the capo body to keep the OctaveTouch fretpad held in place during use. The front center alignment slot feature 230 is designed to allow the front center alignment knub feature to slot through it for alignment and to increase adhesion to the fretpad frame 200. The center slot feature 240 is designed to allow the center knub feature to slot through so that a user can see the radius number when assembled. The rear center alignment slot feature 250 is designed to allow the rear center alignment knub feature to slot through it for alignment and to increase adhesion to the fretpad frame 200. The rubber spring slot 260 provides a cavity where you can adhere or connect the rubber spring.

Figure 7:
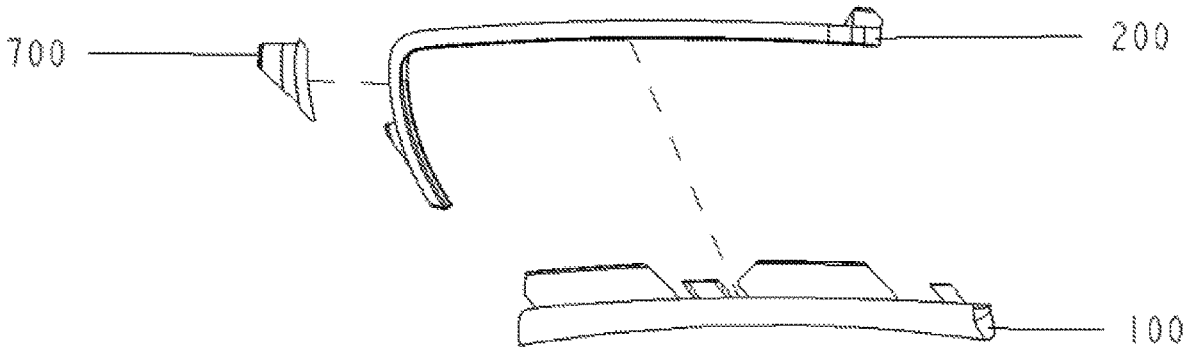
FIG. 7 is an exploded side view diagram the rubber spring and the radiused fretpad insert.

Turning now to FIG. 7, shown is an exploded side view diagram showing how the rubber spring 700 and the radiused fretpad insert 100 connect with the fretpad frame 200. The rubber spring 700 keeps the OctaveTouch fretpad snapped into the metal body of a capo. In one embodiment of the present invention, the rubber spring is manufactured from butyl rubber with a 85 durometer.

Figure 8:
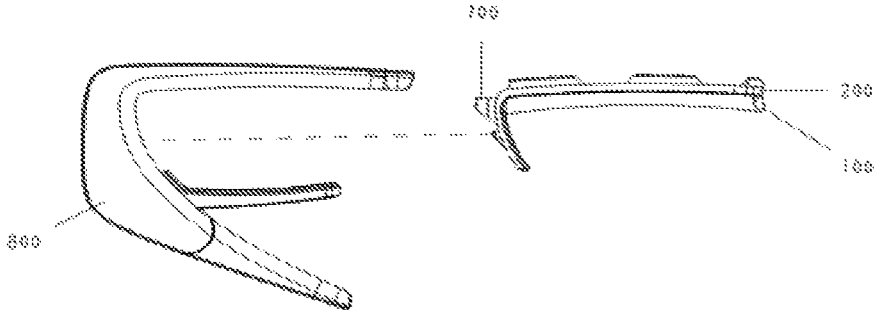
FIG. 8 is an exploded side view diagram the OctaveTouch fretpad.

Turning now to FIG. 8, shown is an exploded side view diagram showing how the OctaveTouch fretpad comprising the radiused fretpad insert 100, rubber spring 700 and fretpad frame 200, connect with a capo 800. This is the metal part of the capo that the fretpad attaches to. The body contains the mechanical features that provides pressure for the capo function. In one embodiment of the invention, the capo body may be made from zinc, aluminum, magnesium or equivalent.

Figure 9:
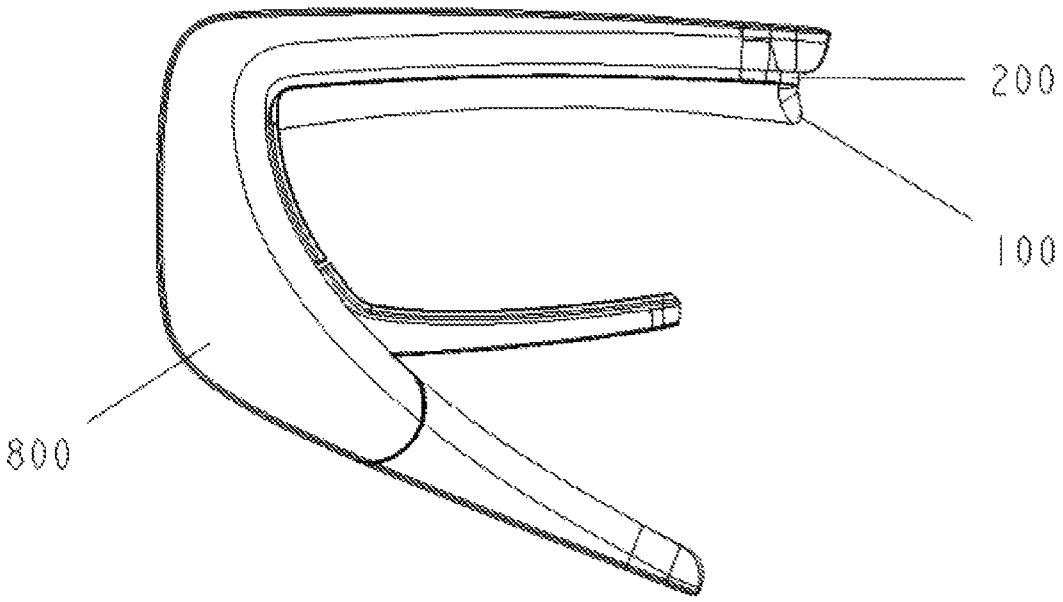
FIG. 9 is a side view diagram showing a capo 800 with an OctaveTouch fretpad.

Turning now to FIG. 9, shown is a side view diagram showing a capo 800 with an OctaveTouch fretpad comprising a fretpad frame 200 and a radiused fretpad insert 100.

Figure 10:
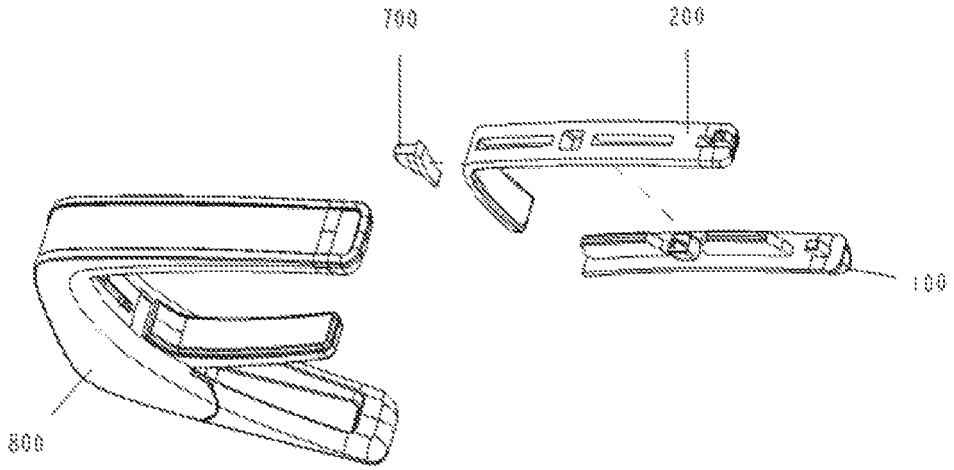
FIG. 10 is an oblique exploded side view diagram of an OctaveTouch fretpad.

Turning now to FIG. 10, shown is an oblique exploded side view diagram showing how the radiused fretpad insert 100, rubber spring 700 and fretpad frame 200 connect together in order to connect to a capo body 800.

Figure 11:
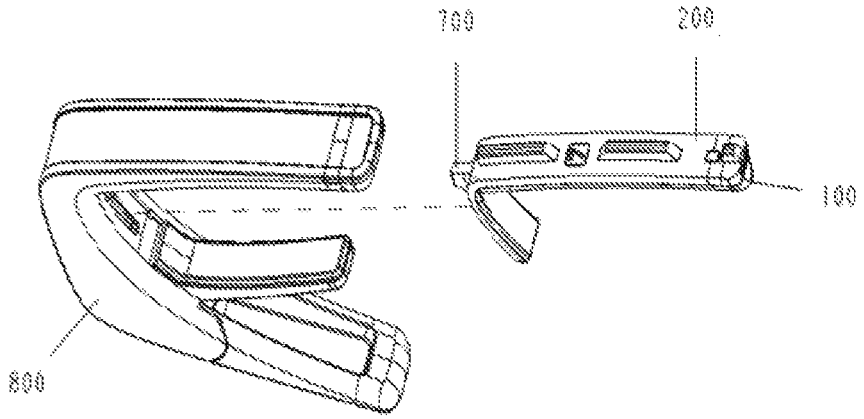
FIG. 11 is an oblique exploded side view diagram of an OctaveTouch fretpad.

Turning now to FIG. 11, shown is an oblique exploded side view diagram showing how the OctaveTouch fretpad comprising a fretpad frame 200 and a radiused fretpad insert 100 is connected to the capo body 800.

Figure 12:
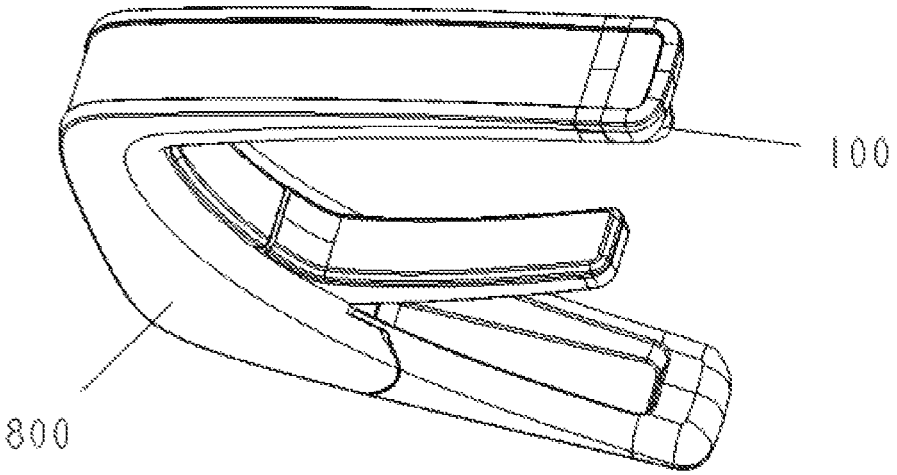
FIG. 12 is an oblique side diagram of a capo with an OctaveTouch fretpad.

Turning now to FIG. 12, shown is an oblique side diagram of a capo body 800 with an OctaveTouch fretpad is installed, in which part of the radiused fretpad insert 100 is shown.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A fretpad for use on a capo comprising:

a radiused fretpad insert, whereby said fretpad insert is curved longitudinally;

a fretpad frame, wherein said radiused fretpad insert is detachably affixed to said fretpad frame, whereby said fretpad frame provides structural support to said radiused fretpad insert;

wherein said radiused fretpad insert has a durometer of between 15 and 40 shore A.

2. The fretpad of claim 1 wherein said radiused fretpad insert is manufactured from silicone.

3. The fretpad of claim 1 wherein said radiused fretpad insert is manufactured from rubber.

4. The fretpad of claim 1 wherein said radiused fretpad insert is manufactured from a mixture of silicone and rubber.

5. The fretpad of claim 1, wherein said radiused fretpad has a durometer of between 20 and 35 shore A.

6. The fretpad of claim 1, wherein said radiused fretpad has a durometer of 30 shore A.

7. The fretpad of claim 1, wherein said radiused fretpad insert is manufactured from silicone rubber.

8. The fretpad of claim 1, wherein said radiused fretpad insert is manufactured from butyl rubber.

9. The fretpad of claim 1, wherein said fretpad frame is manufactured from polycarbonate.

10. The fretpad of claim 1, wherein said fretpad frame is manufactured from ABS.

11. A capo comprising:

a capo body;

a radiused fretpad insert, whereby said fretpad insert is curved longitudinally;

a fretpad frame, wherein said radiused fretpad insert is detachably affixed to said fretpad frame whereby said fretpad frame provides structural support to said radiused fretpad insert and is detachably connected to said capo body;

wherein said radiused fretpad insert has a durometer of between 15 and 40 shore A.

12. The capo of claim 11, wherein said radiused fretpad insert is manufactured from silicone.

13. The capo of claim 11, wherein said radiused fretpad insert is manufactured from rubber.

14. The capo of claim 11, wherein said radiused fretpad insert is manufactured from a mixture of silicone and rubber.

15. The capo of claim 11, wherein said radiused fretpad has a durometer of between 20 and 35 shore A.

16. The capo of claim 11, wherein said radiused fretpad has a durometer of 30 shore A.

17. The capo of claim 11, wherein said radiused fretpad insert is manufactured from silicone rubber.

18. The capo of claim 11, wherein said radiused fretpad insert is manufactured from butyl rubber.

19. The capo of claim 11, wherein said fretpad frame is manufactured from polycarbonate.

20. The capo of claim 11, wherein said fretpad frame is manufactured from ABS.

* * * * *